United States Patent [19]

Ward et al.

[11] 4,359,413

[45] Nov. 16, 1982

[54] SOLID DETERGENT COMPOSITIONS CONTAINING ALPHA-AMINE OXIDE SURFACTANTS

[75] Inventors: James F. Ward; Lawrence A. Gilbert, both of Fairfield, Ohio

[73] Assignee: The Procter & Gamble Company, Cincinnati, Ohio

[21] Appl. No.: 244,536

[22] Filed: Mar. 17, 1981

[51] Int. Cl.[3] ..... C11D 3/10; C11D 1/10

[52] U.S. Cl. ..... 252/527; 252/528; 252/546; 252/547; 252/174.23; 260/404; 562/442; 562/575

[58] Field of Search ..... 252/527, 528, 546, 547; 260/404; 562/442, 575

[56] References Cited

U.S. PATENT DOCUMENTS

| | | | |
|---|---|---|---|
| 83,907 | 10/1979 | Leikhim et al. . | |
| 117,904 | 2/1980 | Ferry . | |
| 2,159,967 | 5/1939 | Engelmann | 260/404 |
| 3,001,945 | 9/1961 | Drew et al. | 252/528 X |
| 3,281,368 | 10/1966 | Zimmerer et al. | 252/528 |
| 3,341,459 | 9/1967 | Davis | 252/547 X |
| 3,442,936 | 5/1969 | Budde | 260/490 |
| 3,647,868 | 3/1972 | Ernst | 252/546 X |
| 3,700,607 | 10/1972 | Sundby et al. | 252/527 |
| 3,843,563 | 10/1974 | Davies et al. | 252/547 |
| 4,247,424 | 1/1981 | Kuzel et al. . | |
| 4,276,205 | 6/1981 | Ferry | 252/528 |

OTHER PUBLICATIONS

Sweeley, et al., Rearrangement and Decarboxylation Reactions of N,N-Dimethylglycine Oxide, J. Am. Chem. Soc., 79:2620-2625 (1957).

Ferris, et al., Detoxication Mechanisms, II, The Iron--Catalyzed Dealkylation of Trimethylamine Oxide, J. Am. Chem. Soc., 89:5270-5275 (1967).

Craig, et al., Tertiary Amine Oxide Rearrangements, I, Mechanism, J. Am. Chem. Soc., 83:1871-1878 (1961).

*Primary Examiner*—P. E. Willis, Jr.

*Attorney, Agent, or Firm*—Donald E. Hasse; Steven J. Goldstein; Jack D. Schaeffer

[57] ABSTRACT

Solid detergent compositions containing alpha-amine oxide surfactants and alkaline materials, which exhibit a pH of greater than 9.0 at a concentration of 1% by weight in water, are disclosed. The alpha-amine oxides have improved stability against metal-catalyzed decomposition in the present compositions. The compositions preferably also contain other surfactants and detergent adjunct materials.

27 Claims, No Drawings

SOLID DETERGENT COMPOSITIONS CONTAINING ALPHA-AMINE OXIDE SURFACTANTS

TECHNICAL FIELD

The present invention relates to solid detergent compositions containing alpha-amine oxide surfactants, which are carboxylic acids or their salts having an amine oxide substituent at the alpha-carbon atom, and alkaline materials which exhibit a pH of greater than 9.0 at a concentration of 1% by weight in water. The compositions herein provide outstanding cleaning, particularly of oily soils, in cool or cold water (i.e., 5°-20° C.) fabric laundering operations. Importantly, the alpha-amine oxides exhibit improved stability against heavy-metal catalyzed decomposition in the present compositions. The compositions preferably also contain other surfactants and detergent adjunct materials.

There has been considerable demand for detergent compositions capable of providing improved cleaning under cold water washing conditions. Besides the obvious economical benefits, there are many convenience and fabric care benefits to be obtained from cold water laundering. For example, dye transfer between fabrics is diminished thereby making it possible to launder mixed colored fabrics without sorting them. Laundering in cold water also results in less wrinkling of fabrics and avoids damage (e.g., shrinkage) to delicate fabrics which should not be washed in hot water.

BACKGROUND ART

U.S. Pat. No. 2,159,967, Engelmann, issued May 30, 1939, discloses carboxylic acids and their salts having an amine oxide substituent at the alpha-carbon atom. The compounds are generally desdribed as being surfactants which can be used for or in admixture with soaps and soap substitutes.

However, it has been found that the alpha-amine oxides have stability problems which can seriously affect their usefulness as detergent surfactants. It is believed that heavy-metal ions, such as copper, cobalt and particularly iron ions, form chelates with the alpha-amine oxides and catalyze their decomposition to relatively insoluble, non-surface active alpha-amino compounds. Trace amounts of such heavy-metal ions (e.g., on the order of parts per million or less) normally present in detergent compositions can cause substantial decomposition of the alpha-amine oxides over a period of time.

The instability of the alpha-amine oxides is also partly due to the fact that structurally they are secondary amine oxides (i.e., the carbon atom next to the amine oxide substituent is attached to 2 other carbon atoms, instead of just one carbon atom as with primary amine oxides). As such, they decompose according to the Cope elimination reaction more readily than the primary amine oxides commonly used in the detergent industry (e.g., the alkyl dimethylamine oxides). However, since the alpha-beta unsaturated acids or salts formed by Cope elimination provide some detergency, the aforementioned metal-catalyzed decomposition represents the more serious stability problem.

SUMMARY OF THE INVENTION

The present invention encompasses solid detergent compositions comprising:

(a) from about 1% to about 80% by weight of an amine oxide surfactant of the formula

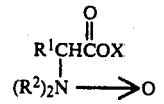

wherein $R^1$ is hydrogen or a $C_1$-$C_{20}$ hydrocarbyl group; each $R^2$ is a $C_1$-$C_{20}$ hydrocarbyl group or a $C_2$-$C_3$ alkylene oxide group containing from 1 to about 10 alkylene oxide units; and X is hydrogen or a water-soluble metal, ammonium or substituted ammonium cation; provided that the total number of carbon atoms in hydrocarbyl groups at the $R^1$ and $R^2$ substituents is from about 8 to about 36; and (b) from about 2% to about 99% by weight of an alkaline material which exhibits a pH of greater than 9.0 at a concentration of 1% by weight in water.

DETAILED DESCRIPTION OF THE INVENTION

The solid detergent compositions herein containing the alpha-amine oxide surfactants provide outstanding cleaning, particularly of oily soils, in cool or cold water fabric laundering operations. The compositions can, of course, also be effectively used in warm or hot water according to the desires of the user.

It has now been discovered that the stability of the alpha-amine oxides with respect to metal-catalyzed decomposition can be improved by incorporating them in solid detergent compositions containing alkaline materials which exhibit a pH of greater than 9.0 at a concentration of 1% by weight in water. While not intending to be limited by theory, it is believed that the heavy-metal ions cannot readily form chelates with the alpha-amine oxides in such compositions for a number of reasons. First of all, the high local pH provided by the alkaline materials herein promotes the formation of metal oxides and decreases the availability of metal ions for chelating with the alpha-amine oxides. Secondly, the alkaline materials herein, particularly some of the detergent builders, are effective chelators themselves and thus compete with the alpha-amine oxides for the metal ions. Finally, the low moisture levels encountered in the solid compositions herein can enhance stability of the alpha-amine oxides by restricting the mobility of the metal ions.

Alpha-Amine Oxide Surfactant

In the general formula for the alpha-amine oxide surfactants herein, $R^1$ can be hydrogen or any $C_1$-$C_{20}$ hydrocarbyl group, such as a straight or branched chain alkyl, alkenyl, alkynyl, alkaryl (e.g., alkylphenyl or alkylbenzyl), or substituted hydrocarbyl (e.g., hydroxyalkyl) group. The nature of substituent $R^1$ can be varied by the selection of the parent carboxylic acid used in the reaction scheme for making the alpha-amine oxides, as disclosed hereinafter. (Although the alpha-substituted alkyaryl and unsaturated carboxylic acids are not readily available by the process disclosed in U.S. Pat. No. 4,148,811, Crawford, issued Apr. 10, 1979, they can be prepared using other known reactions.) Typical carboxylic acid starting materials include acetic acid, propionic acid, butyric acid, valeric acid, caproic acid, caprylic acid, capric acid, lauric acid, myristic acid, palmitic acid, stearic acid, oleic acid, linoleic acid, linolenic acid, eicosanoic acid, mixed coconut oil fatty acids, mixed palm oil fatty acids, mixed lard fatty acids, mixed soybean oil fatty acids, and mixed tallow fatty acids, which are preferred for cost considerations, $R^1$ is preferably a $C_8$–$C_{20}$ hydrocarbyl group, and most preferably a $C_{10}$–$C_{16}$ alkyl group.

Each $R^2$ substituent of the alpha-amine oxide surfactant can be any $C_1$–$C_4$ hydrocarbyl group or a $C_2$–$C_3$ alkylene, preferably ethylene, oxide group containing from 1 to about 10, preferably 1 to about 5, alkylene oxide units. Such a $C_2$–$C_3$ alkylene oxide group would commonly, and preferably, be terminated with a hydrogen atom, but also can be terminated with a methyl, ethyl or propyl group. Each $R^2$ is preferably a $C_1$–$C_4$ hydrocarbyl group, and more preferably a methyl, ethyl, 2-hydroxyethyl or 2-hydroxypropyl group.

Substituent X can be hydrogen or a water-soluble metal, ammonium or substituted ammonium cation. Suitable water-soluble metal cations include any of the alkali metal and alkaline earth metal cations. Useful substituted ammonium cations include, for example, the methyl-, dimethyl-, trimethyl-, diethanol- and triethanolammonium cations and quaternary ammonium cations such as tetramethylammonium and dimethyl piperidinium cations. Preferably, X is a water-soluble alkali metal cation. Most preferably, X is sodium.

It will be appreciated that the above substituents should be selected such that the compounds herein exhibit sufficient surface activity and solubility for their intended use. Thus, the total number of carbon atoms in hydrocarbyl groups at the $R^1$ and $R^2$ substituents should be from about 8 to about 36, preferably from about 12 to about 26. Additionally, when the compounds herein have relatively long hydrocarbyl chains at the $R^1$ and one of the $R^2$ substituents, it is preferred that the other $R^2$ substituent be a $C_2$–$C_3$ alkylene (preferably ethylene) oxide group for optimum solubility, especially in cold water.

The economical practice of the present invention on an industrial scale ultimately depends on a ready source of alpha-halo carboxylic acids, from which the alpha-amine oxide surfactants herein are derived. Alpha-bromo carboxylic acids, which are available via the Hell-Volhard-Zelinsky reaction, are suitable starting materials. However, H-V-Z alpha-bromo acids are quite expensive. Fortunately, high quality, low cost alpha-chloro carboxylic acids suitable for use in preparing the alpha-amine oxides herein are available by the process disclosed in U.S. Pat. No. 4,148,811, Crawford, issued Apr. 10, 1979, incorporated herein by reference. Additionally, a preferred process for preparing 1,4-bis(-dicyanomethylene) cyclohexane, the precursor of the tetracyanoquinodimethane (TCNQ) used in the above process, is disclosed in U.S. Pat. No. 4,229,364, Crawford, issued Oct. 21, 1980, incorporated herein by reference.

The following is a typical synthesis of alpha-dimethylamine oxide tallow acid, used alpha-chloro tallow acid obtained via the process disclosed in U.S. Pat. No. 4,148,811, Crawford, as a representative starting material.

Preparation of Alpha-Dimethylamino Tallow Acid: A 2000 ml. 3-neck round bottom flask was fitted with a magnetic stirrer, dry ice reflux condenser, and thermometer. The flask was then charged with 750 ml. (4.2 moles) of 25% aqueous dimethylamine, 100 g. (0.33 mole) of alpha-chloro tallow acid, and 13.3 g. (0.33 mole) of sodium hydroxide. The resulting solution was stirred for 4 hours at 65° C. The dry ice condenser was removed and as much as possible of the excess dimethylamine was evaporated from the solution with a stream of nitrogen while stirring the solution at 50°–70° C. The evaporation of the dimethylamine was discontinued when the solution became too viscous to control the foaming. The reaction mixture was diluted with 2000 ml. of hot ethyl alcohol and allowed to cool slowly for crystallization. The crystallized product was collected by suction filtration, washed with alcohol and vacuum dried to afford 88 g. (86% yield) of alpha-dimethylamino tallow acid, having a melting point of 141°–142° C.

Preparation of Alpha-Dimethylamine Oxide Tallow Acid: A 1000 ml. 3-neck round bottom flask equipped with a thermometer and magnetic stirrer was charged with 100 g. (0.31 mole) of alpha-dimethylamino tallow acid dissolved in 310 ml. of 1 N sodium hydroxide and 150 ml. of ethyl alcohol. The solution was heated to 40°–45° C. while adding 54 g. (0.48 mole) of 30% hydrogen peroxide. The temperature rose to 55°–60° C. during addition of the hydrogen peroxide. The resulting solution was allowed to stir for 4 hours at 60° C. After cooling to 25° C., the solution was poured into a separatory funnel containing 150 ml. of glacial acetic acid and 200 ml. of distilled water, and extracted with two 500 ml. portions of chloroform. The organic layers were combined and stripped of all volatile material. The residual material was recrystallized from 700 ml. of acetone at 0° C. to give 90 g. (86% yield) of alpha-dimethylamine oxide tallow acid, having a melting point of 121.5°–123° C.

The solid detergent compositions herein contain from about 1% to about 80%, preferably from about 2% to about 40%, and more preferably from about 3% to about 15%, by weight of the alpha-amine oxide surfactant.

Alkaline Material

The detergent compositions of the present invention also contain from about 2% to about 99%, preferably from about 15% to about 80%, and more preferably from about 30% to about 60%, by weight of an alkaline material which exhibits a pH of greater than 9.0, preferably greater than 9.5, at a concentration of 1% by weight in water.

Suitable alkaline materials include the alkali metal (preferably sodium) hydroxides and metasilicates. However, such highly alkaline materials are generally used only in small amounts, if at all, in consumer products for safety reasons. They can be used in greater amounts in industrial detergent products.

The alkaline materials herein are more commonly selected from those compounds known as detergent builder materials. Detergency builders are generally characterized by an ability to sequester water hardness ions, particularly calcium and magnesium. These builders also possess varying degrees of ability to sequester or chelate the heavy-metal ions which catalyze the decomposition of the alpha-amine oxides. Builders are also commonly used to provide or assist in maintaining an alkaline pH in the washing solution.

Almost all builder materials commonly taught for use in detergent compositions are suitable for use herein as the alkaline material. Exceptions include the bicarbonates (sodium bicarbonate has a pH of about 8.4 in a 1% solution) and the tetraphosphates (sodium tetraphosphate has a pH of about 8.5 in a 1% solution). Useful detergency builders include the various water-soluble alkali metal, ammonium and alkanolammonium phosphates, polyphosphates, phosphonates, polyphosphonates, carbonates, silicates, borates, polyhydroxysulfonates, polyacetates, carboxylates, and polycarboxylates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate, which is preferred because of its high alkalinity. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of non-phosphorus, inorganic builders are the sodium and potassium carbonates, sesquicarbonates, silicates, and borates (e.g., tetraborate decahydrate and metaborate tetrahydrate). The carbonates and silicates are particularly useful herein because of their high alkalinity. Suitable silicate solids have a molar ratio of $SiO_2$ to alkali metal oxide in the range from about 1:2 to about 4:1, and preferably from about 1.6:1 to about 2.4:1. Useful silicates include the anhydrous silicates disclosed in U.S. Pat. No. 4,077,897, Gault, issued Mar. 7, 1978, incorporated herein by reference, which have a particle size of between about 125 and about 300 mesh, preferably from about 190 to 250 mesh. The silicates are particularly preferred in the present compositions because they provide corrosion inhibition protection to the metal parts of washing machines and also provide a certain degree of crispness and pourability to spray-dried detergent granules.

Water-soluble, non-phosphorus organic builders useful herein include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred polycarboxylate builders herein are set forth in U.S. Pat. No. 3,308,067, Diehl, issued Mar. 7, 1967 incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other useful builders herein are sodium and potassium carboxymethyloxymalonate, carboxymethyloxysuccinate, cis-cyclohexanehexacarboxylate, cis-cyclopentanetetracarboxylate phloroglucinol trisulfonate, and the copolymers of maleic anhydride with vinyl methyl ether or ethylene.

Other suitable polycarboxylates for use herein are the polyacetal carboxylates described in U.S. Pat. No. 4,144,226, issued Mar. 13, 1979 to Crutchfield, et al., and U.S. Pat. No. 4,146,495, issued Mar. 27, 1979 to Crutchfield, et al., both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Other detergency builder materials useful herein are the "seeded builder" compositions disclosed in Belgian Pat. No. 798,856, issued Oct. 29, 1973, incorporated herein by reference. Specific examples of such seeded builder mixtures are: 3:1 wt. mixtures of sodium carbonate and calcium carbonate having 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

Detergency builder materials useful in the present invention also include the insoluble amorphous and crystalline aluminosilicates disclosed in European Patent Application No. 80200524.9, Rodriguez, et al., filed June 9, 1980, incorporated herein by reference. Particularly useful are the aluminosilicates commonly known as Zeolites A, X, and P(B).

Most preferably, the alkaline material herein comprises a detergent builder selected from the group consisting of sodium and potassium orthophosphates, carbonates, silicates having a molar ratio of $SiO_2$ to alkali metal oxide of from about 1.6:1 to about 2:4:1, and mixtures thereof. These materials are readily available and provide the high local alkalinity required for optimum stability of the alpha-amine oxides. It is especially preferred that the alkaline material comprises sodium carbonate, sodium silicate having a molar ratio of from about 1.6:1 to about 2.4:1, or mixtures thereof. A particularly preferred builder system herein comprises from about 2% to about 10% by weight of the detergent composition of sodium silicate having a molar ratio of from about 1.6:1 to about 2.4:1 and from about 10% to about 30% by weight of the detergent composition of sodium carbonate.

While the above highly alkaline materials (i.e., orthophosphates, carbonates and silicates) are preferred for optimum stability of the alpha-amine oxides, the detergent compositions herein normally will also contain some of the other less alkaline builder materials for optimum detergency performance. Such builders can reduce the overall alkalinity of the compositions herein and thus slightly decrease the stability of the alpha-amine oxides. Accordingly, a preferred process for preparing the solid compositions herein involves spraying a concentrated solution or slurry of the alpha-amine oxide directly onto a carrier granule containing the highly alkaline materials. The loaded carrier granule is then admixed with granules containing the balance of the detergent ingredients, which can be prepared by conventional spray-drying or agglomeration (e.g., fluid bed) processes. Such a process provides more intimate contact between the alpha-amine oxides and the highly alkaline materials and should therefore result in greater stability than when all components are spray-dried from one crutcher mix.

When spray-drying compositions containing the alpha-amine oxides herein, it is preferred that temperatures be less than 260° C., and preferably less than 230° C., since the stability of the alpha-amine oxides, both with respect to metal-catalyzed decomposition and Cope elimination, is reduced at higher temperatures. Furthermore, storage temperatures should be less than 60° C., and preferably less than 50° C., for greatest stability.

Additionally, the use of more than 10% by weight of the alkali metal silicates in spray-dried detergent compositions herein can present solubility problems under cold water usage conditions, especially when sodium aluminosilicate builders are also present in the composition. U.S. Pat. No. 3,985,669, Krummel, et al., issued Oct. 12, 1976, incorporated herein by reference, discloses the preferred use of low levels of silicates in detergent compositions also containing aluminosilicate builders. However, admixing powdered alkali metal silicates with spray-dried granular compositions containing the aluminosilicates reduces interactions between the silicates and aluminosilicates and thus can improve the solubility of granular detergents containing both components.

Detergent compositions of the present invention also preferably contain one or more organic cosurfactants selected from the group consisting of anionic, cationic, nonionic, ampholytic and zwitterionic surfactants, and mixtures thereof. These surfactants are described in U.S. Pat. No. 3,919,678, Laughlin et al., issued Dec. 30, 1975, incorporated herein by reference. Useful cationic surfactants also include those described in U.S. Pat. No. 4,222,905, Cockrell, issued Sept. 16, 1980, incorporated herein by reference. The cosurfactant represents from about 1% to about 40%, preferably from about 2% to about 30%, more preferably from about 5% to about 20%, by weight of the detergent composition.

Preferred cosurfactants herein are the nonionic surfactants described in U.S. Pat. No. 3,929,678, cited above, from column 13, line 14 to column 16, line 6. Particularly preferred nonionic surfactants are the ethoxylated alcohols or ethoxylated alkyl phenols of the formula $R(OCH_2CH_2)_nOH$, where R is a $C_8$–$C_{18}$ hydrocarbyl group or a $C_8$–$C_{15}$ alkyl phenyl group and n is from about 3 to about 12. Of this group, the ethoxylated alcohols are preferred because of their superior biodegradability. Particularly preferred are the ethoxylated alcohols in which R is a $C_9$–$C_{15}$ alkyl group and n is from about 4 to about 8. A preferred weight ratio of the above nonionic surfactants to the alpha-amine oxide surfactants herein is from about 1:4 to about 4:1, more preferably from about 1:2 to about 2:1.

Useful anionic cosurfactants specifically include those described in U.S. Pat. No. 3,929,678 from column 23, line 57 to column 35, line 20, and those described in U.S. Pat. No. 4,199,483, Jones, issued Apr. 22, 1980, from column 5, line 3 to column 6, line 26, incorporated herein by reference.

Specific preferred anionics for use herein include: the linear $C_9$–$C_{15}$ alkylbenzene sulfonates (LAS); the branched $C_9$–$C_{15}$ alkylbenzene sulfonates (ABS); the tallow alkyl sulfates, the coconut alkyl glyceryl ether sulfonates; the sulfated condensation products of mixed $C_{10}$–$C_{18}$ fatty alcohols with from about 1 to about 14 moles of ethylene oxide; and the mixtures of higher fatty acid soaps containing from 10 to 18 carbon atoms.

Other ingredients commonly used in detergent compositions can be included in the compositions of the present invention. These include color speckles, bleaching agents and bleach acitvators, suds boosters or suds suppressors, anti-tarnish and anti-corrosion agents, soil suspending agents, soil release agents, dyes, fillers, optical brighteners, germicides, pH adjusting agents, non-builder alkalinity sources, hydrotropes, enzymes, enzyme-stability agents and perfumes.

A preferred optional component in the present compositions is the alkylene oxide condensation product described in U.S. Pat. No. 4,000,080, Bartolotia, et al., issued Dec. 28, 1976, particularly from column 8, line 1 through column 9, line 10, incorporated herein by reference. Such alkylene oxide condensation products, which preferably are polyethylene glycols having a molecular weight from about 3000 to about 9000, are believed to enhance the cold water cleaning performance of the present compositions, especially on hard to remove soils such as those found on pillowcases.

The following non-limiting examples illustrate the detergent compositions of the present invention.

All percentages, parts, and ratios used herein are by weight unless otherwise specified.

EXAMPLE I

The stability of sodium alpha-dimethylamine oxide tallowate was evaluated in solid Compositions A and B as follows. Composition A was a spray-dried granular composition containing 10% sodium alpha-dimethylamine oxide tallowate, 32% sodium tripolyphosphate, 20% sodium carbonate, 17% sodium sulfate, 6% sodium silicate (1.6 r), and 15% water. Composition B, containing about 20% sodium alpha-dimethylamine oxide tallowate and about 80% sodium carbonate, was obtained by spraying a concentrated solution of the alpha-amine oxide onto carbonate carrier granules.

After storage for 28 days at a temperature of 49° C., none of the two primary metal-catalyzed decomposition products, sodium alpha-monomethylamino tallowate (MMAT) and sodium alpha-dimethylamino tallowate (DMAT), were found. Furthermore, Composition B exhibited less Cope decomposition than Composition A (7% versus 20%).

For comparison, the stability (as determined by % MMAP and % DMAT) of sodium alpha-dimethylamine oxide tallowate in aqueous solution was evaluated at 49° C. as a function of pH of the solution and iron concentration. All solutions were first passed through a Chelex-100 ion exchange resin to reduce the iron concentration to a uniformly low level. Iron (as ferrous sulfate) was then added back to some of the solutions as indicated. After 7 days, the results were as follows.

TABLE I

| Temperature (°C.) | pH | Added Fe (ppm) | MMAT (%) | DMAT (%) |
|---|---|---|---|---|
| 49 | 9.5 | 0 | 13 | 3 |
| 49 | 10.5 | 0 | 7 | 2 |
| 49 | 11.5 | 0 | 8 | 6 |
| 49 | 9.5 | 5.0 | 23 | 6 |
| 49 | 10.5 | 2.5 | 15 | 4 |
| 49 | 11.5 | 20 | 11 | 5 |

The above data demonstrate that the stability of the alpha-amine oxides can be significantly improved by incorporating them in the solid detergent compositions of the present invention.

EXAMPLE II

The following are granular detergent compositions according to the present invention.

| Component | A | B | C | D |
|---|---|---|---|---|
| $C_{12-13}E_{6.5}$ nonionic surfactant* | 10.0 | | | 10.0 |

-continued

| Component | A | B | C | D |
|---|---|---|---|---|
| Sodium $C_{13}$ linear alkylbenzene sulfonate | | | 12.0 | |
| Sodium alpha-dimethylamine oxide cocoate | 6.0 | 5.0 | | |
| Sodium alpha-dimethylamine oxide tallowate | | | 6.0 | 5.0 |
| Sodium tripolyphosphate | 25.0 | 25.0 | | 32.0 |
| Sodium aluminosilicate (hydrated Zeolite A, particle diameter 1-10 microns) | | 18.0 | 18.0 | |
| Sodium nitrilotriacetate | 18.0 | | 18.0 | |
| Sodium carbonate | 10.0 | 10.0 | 12.0 | 20.00 |
| Sodium silicate (1.6r) | 6.0 | 2.0 | 3.0 | 6.0 |
| Sodium sulfate | 10.0 | 32.0 | 24.0 | 9.3 |
| Bentolite L clay** | 3.5 | | | 3.5 |
| Polyethylene glycol 6000 | | | | 0.9 |
| Water and miscellaneous | | Balance to 100 | | |

*Condensation product of $C_{12-13}$ linear primary alcohol with 6.5 moles (avg.) of ethylene oxide.
**A calcium bentonite clay manufactured by Georgia Kaolin Co.

Compositions A, B and C are produced by admixing all components in a crutcher to form a homogeneous mix, and then spray-drying the mix in a conventional manner at a temperature of about 220° C.

In Composition D, a concentrated solution of the sodium alpha-dimethylamine oxide tallowate is sprayed onto sodium carbonate granules using a two-fluid atomizer nozzle. The loaded granules and the polyethylene glycol are then admixed with granules containing the remaining components, obtained by a conventional spray-drying operation, to form the final detergent composition.

The above compositions, when used at a level of about 1400 parts per million (ppm), provide excellent cleaning of soiled fabrics in water having a temperature of about 15° C.

Other compositions within the scope of the present invention are obtained by replacing the alpha-amine oxides in the above compositions with the corresponding compounds derived from capric acid, lauric acid, myristic acid, palmitic acid, stearic acid, oleic acid, mixed palm oil fatty acids, mixed lard fatty acids, and mixed soybean oil fatty acids.

Other compositions are obtained by replacing the above alpha-amine oxides with sodium alpha-coconutalkylmethylamine oxide cocoate, sodium alpha-dicoconutalkylamine oxide acetate, sodium alpha-tallowalkyltriethoxylateamine oxide acetate, and sodium alpha-stearylethanolamine oxide propionate.

What is claimed is:

1. A solid detergent composition comprising:

(a) from about 1% to about 80% by weight of an amine oxide surfactant of the formula

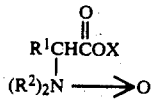

wherein $R^1$ is hydrogen or a $C_1$–$C_{20}$ hydrocarbyl group; each $R^2$ is a $C_1$–$C_{20}$ hydrocarbyl group or a $C_2$–$C_3$ alkylene oxide group containing from 1 to about 10 alkylene oxide units; and X is hydrogen or a water-soluble metal, ammonium or substituted ammonium cation; provided that the total number of carbon atoms in hydrocarbyl groups at the $R^1$ and $R^2$ substituents is from about 8 to about 36; and (b) from about 2% to about 99% by weight of an alkaline material which exhibits a pH of greater than 9.0 at a concentration of 1% by weight in water.

2. A composition according to claim 1 wherein the total number of carbon atoms in hydrocarbyl groups at the $R^1$ and $R^2$ substituents is from about 12 to about 26.

3. A composition according to claim 1 wherein the alkaline material exhibits a pH of greater than 9.5 at a concentration of 1% by weight in water.

4. A composition according to claim 1 wherein the alkaline material comprises a detergent builder material.

5. A composition according to claim 4 comprising from about 2% to about 40% by weight of the amine oxide surfactant.

6. A composition according to claim 5 comprising from about 3% to about 15% by weight of the amine oxide surfactant.

7. A composition according to claim 4 comprising from about 15% to about 80% by weight of the alkaline material.

8. A composition according to claim 7 comprising from about 30% to about 60% by weight of the alkaline material.

9. A composition according to claim 8 comprising from about 3% to about 15% by weight of the amine oxide surfactant.

10. A composition according to claims 4 or 9 wherein the alkaline material exhibits a pH of greater than 9.5 at a concentration of 1% by weight in water.

11. A composition according to claim 4 wherein $R^1$ is a $C_{10}$–$C_{16}$ alkyl group and each $R^2$ is a $C_1$–$C_4$ hydrocarbyl group or an ethylene oxide group containing from 1 to about 5 ethylene oxide units.

12. A composition according to claim 4 wherein each $R^2$ is a methyl, ethyl, 2-hydroxyethyl or 2-hydroxypropyl group.

13. A composition according to claim 4 wherein X is an alkali metal cation.

14. A composition according to claim 13 wherein X is sodium.

15. A composition according to claim 4 wherein $R^1$ is a $C_{10}$–$C_{16}$ alkyl group, each $R^2$ is a methyl, ethyl, 2-hydroxyethyl or 2-hydroxypropyl group, and X is sodium.

16. A composition according to claim 4 wherein the detergent builder material is selected from the group consisting of alkali metal phosphates, polyphosphates, polyphosphonates, carbonates, silicates, borates, polyacetates, polycarboxylates, aluminosilicates, and mixtures thereof.

17. A composition according to claim 16 wherein the detergent builder material comprises an alkali metal orthophosphate, carbonate, or silicate having a molar ratio of $SiO_2$ to alkali metal oxide of from about 1.6:1 to about 2.4:1, or mixtures thereof.

18. A composition according to claim 17 wherein the detergent builder material comprises sodium carbonate, sodium silicate having a molar ratio of $SiO_2$ to alkali metal oxide of from about 1.6:1 to about 2.4:1, or mixtures thereof.

19. A composition according to claims 16 or 18 wherein $R^1$ is a $C_{10}$–$C_{16}$ alkyl group, each $R^2$ is a methyl, ethyl, 2-hydroxyethyl or 2-hydroxypropyl group, and X is sodium.

20. A composition according to claim 4 further comprising from about 1% to about 40% by weight of an anionic, cationic, nonionic, ampholytic, or zwitterionic cosurfactant, or mixtures thereof.

21. A composition according to claim 20 comprising from about 2% to about 30% by weight of the cosurfactant.

22. A composition according to claim 21 comprising from about 5% to about 20% by weight of the cosurfactant.

23. A composition according to claim 20 wherein the cosurfactant is an ethoxylated alcohol or alkyl phenol of the formula $R(OCH_2CH_2)_nOH$, wherein R is a $C_8$–$C_{18}$ hydrocarbyl group or a $C_8$–$C_{15}$ alkyl phenyl group and n is from about 3 to about 12.

24. A composition according to claim 23 wherein R is a $C_9$–$C_{15}$ alkyl group and n is from about 4 to about 8.

25. A composition according to claims 20 or 24 wherein $R^1$ is a $C_{10}$–$C_{16}$ alkyl group, each $R^2$ is a methyl, ethyl, 2-hydroxyethyl or 2-hydroxypropyl group, and X is sodium.

26. A composition according to claim 25 comprising from about 3% to about 15% by weight of the amine oxide surfactant and from about 5% to about 20% by weight of the cosurfactant.

27. A composition according to claim 26 wherein the detergent builder material comprises sodium carbonate, sodium silicate having a ratio of from about 1.6:1 to about 2.4:1, or mixtures thereof.

* * * * *